US008556750B2

(12) United States Patent
Ichikawa et al.

(10) Patent No.: US 8,556,750 B2
(45) Date of Patent: Oct. 15, 2013

(54) GOLF BALL WITH COVER HAVING VARYING HARDNESS

(75) Inventors: Yasushi Ichikawa, Tualatin, OR (US); Chia-Chyi Cheng, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 666 days.

(21) Appl. No.: 12/690,761

(22) Filed: Jan. 20, 2010

(65) Prior Publication Data

US 2011/0177884 A1 Jul. 21, 2011

(51) Int. Cl.
*A63B 37/06* (2006.01)

(52) U.S. Cl.
USPC ..... 473/378

(58) Field of Classification Search
USPC ..... 473/378
See application file for complete search history.

(56) References Cited

U.S. PATENT DOCUMENTS

| | | | |
|---|---|---|---|
| 1,482,232 | A | 1/1924 | Hazeltine |
| 1,855,448 | A | 4/1932 | Hazeltine |
| 2,861,810 | A | 11/1958 | Veatch |
| 3,031,194 | A | 4/1962 | Strayer |
| 4,235,441 | A | 11/1980 | Ciccarello |
| 4,660,830 | A | 4/1987 | Tomar |
| 4,863,167 | A | 9/1989 | Matsuki et al. |
| 5,651,741 | A | 7/1997 | Masutani et al. |
| 5,783,293 | A | 7/1998 | Lammi |
| 5,827,567 | A | 10/1998 | Molitor |
| 5,873,796 | A | 2/1999 | Cavallaro et al. |
| 5,984,806 | A | 11/1999 | Sullivan et al. |
| 5,994,472 | A | 11/1999 | Egashira et al. |
| 6,010,442 | A | 1/2000 | Lemons et al. |
| 6,012,992 | A | 1/2000 | Yavitz |
| 6,103,166 | A | 8/2000 | Boehm et al. |
| 6,193,617 | B1 | 2/2001 | Mertens |
| 6,218,453 | B1 | 4/2001 | Boehm et al. |
| 6,342,019 | B1 | 1/2002 | Boehm et al. |
| 6,383,091 | B1 | 5/2002 | Maruko et al. |
| 6,392,002 | B1 | 5/2002 | Wu |
| 6,398,667 | B1 | 6/2002 | Lemons |
| 6,422,954 | B1 | 7/2002 | Dewanjee |

(Continued)

FOREIGN PATENT DOCUMENTS

| | | |
|---|---|---|
| CA | 2728070 | 3/2011 |
| CA | 2775128 | 5/2013 |

(Continued)

OTHER PUBLICATIONS

Office Action for U.S. Appl. No. 12/831,940, mailed on May 10, 2012.

(Continued)

*Primary Examiner* — Raeann Gorden
(74) *Attorney, Agent, or Firm* — Plumsea Law Group, LLC

(57) ABSTRACT

Generally disclosed is a golf ball having a core and a cover layer. The cover layer includes areas that are hard corresponding to the dimples, and areas that are soft corresponding to the land between the dimples. The cover layer may be selectively treated, such as by heating, to achieve a difference in hardness using a single cover layer material. Alternatively, the cover layer may be selectively coated with a coating material having a different hardness. As a result of the arrangement of the hard dimples and the soft land, the golf ball achieves reduced spin, and greater distances, when struck with a larger force (such as during a dive) while also achieving increased spin, and better control, when struck with a smaller force (such as during a chip).

7 Claims, 15 Drawing Sheets

(56) References Cited

U.S. PATENT DOCUMENTS

| | | | |
|---|---|---|---|
| 6,433,094 | B1 | 8/2002 | Nesbitt et al. |
| 6,454,666 | B1 | 9/2002 | Shira |
| 6,464,600 | B2 | 10/2002 | Takemura et al. |
| 6,575,847 | B1 | 6/2003 | Yamagishi et al. |
| 6,585,607 | B2 | 7/2003 | Tzivanis et al. |
| 6,648,776 | B1 | 11/2003 | Boehm et al. |
| 6,648,778 | B2 | 11/2003 | Sullivan et al. |
| 6,699,143 | B2 | 3/2004 | Nardacci et al. |
| 6,743,123 | B2 | 6/2004 | Sullivan |
| 6,802,787 | B2 | 10/2004 | Ogg |
| 6,827,657 | B2 | 12/2004 | Sullivan et al. |
| 6,832,963 | B2 | 12/2004 | Sullivan et al. |
| 6,835,793 | B2 | 12/2004 | Yokota et al. |
| 7,022,034 | B2 | 4/2006 | Sullivan et al. |
| 7,041,011 | B2 | 5/2006 | Sullivan et al. |
| 7,048,656 | B2 | 5/2006 | Litchfield |
| 7,125,345 | B2 | 10/2006 | Sullivan et al. |
| 7,160,209 | B2 | 1/2007 | Marotta et al. |
| 7,195,564 | B2 | 3/2007 | Han |
| 7,255,655 | B2 | 8/2007 | Gojny |
| 7,278,930 | B2 | 10/2007 | Yokota et al. |
| 7,278,931 | B2 | 10/2007 | Manami et al. |
| 7,429,220 | B2 | 9/2008 | Kuntimaddi et al. |
| 7,470,203 | B1 | 12/2008 | Stillinger |
| 7,601,080 | B2 | 10/2009 | Olson et al. |
| 7,926,645 | B2 | 4/2011 | Contoli et al. |
| 2001/0019969 | A1 | 9/2001 | Binette et al. |
| 2002/0019269 | A1 | 2/2002 | Watanabe |
| 2004/0132552 | A1 | 7/2004 | Chen |
| 2008/0064527 | A1 | 3/2008 | Wu et al. |
| 2008/0081710 | A1 | 4/2008 | Chen et al. |
| 2008/0251400 | A1 | 10/2008 | Ulrich |
| 2009/0017941 | A1 | 1/2009 | Sullivan et al. |
| 2009/0205931 | A1 | 8/2009 | Contoli et al. |
| 2011/0177884 | A1 | 7/2011 | Ichikawa et al. |
| 2011/0177887 | A1 | 7/2011 | Ichikawa et al. |
| 2011/0177890 | A1 | 7/2011 | Tutmark |

FOREIGN PATENT DOCUMENTS

| | | | |
|---|---|---|---|
| CN | 101002986 | A | 7/2007 |
| CN | ZL201120022039.5 | | 1/2011 |
| CN | 201988125 | | 9/2011 |
| CN | ZL201120021903.X | | 2/2012 |
| CN | ZL201120237927.9 | | 5/2012 |
| CN | ZL201110025876.8 | | 2/2013 |
| EP | 0476147 | | 3/1992 |
| EP | 2347799 | | 1/2013 |
| EP | 2481450 | | 5/2013 |
| JP | 60-171459 | | 11/1985 |
| JP | 06277312 | | 10/1994 |
| JP | 09182814 | | 7/1997 |
| JP | 2002000765 | | 1/2002 |
| JP | 2002224241 | | 8/2002 |
| JP | 2008155013 | | 7/2008 |
| KR | 1087414 | | 11/2011 |
| TW | I303180 | | 11/2008 |
| WO | 9843711 | | 10/1998 |
| WO | WO2008118629 | | 10/2008 |

OTHER PUBLICATIONS

Extended European Search Report dated Jan. 3, 2012 in European Patent Application No. EP11172727.7.
International Search Report and Written Opinion for PCT/US2011/020996, mailed Jul. 4, 2011.
European Search Report for European Patent Application No. EP12001388.3, mailed on Jul. 3, 2012.
Extended European Search Report dated Jul. 4, 2011 in European Application No. 11151551.6.
Office Action for Japanese Patent Application No. 2011-003995 mailed on Feb. 19, 2013.
Office Action for Japanese Patent Application No. 2011-005928 mailed on Feb. 19, 2013.
Notification of Grant of Patent Right for Invention issued Oct. 24, 2012 in Chinese Patent Application No. 201110025876.8.
Notification of Grant of Patent Right for Utility Model issued Dec. 23, 2011 in Chinese Patent Application No. 201120021903.X.
Communication under Rule 71(3) EPC mailed May 22, 2012 for European Patent Application No. 11 151 551.6.
Notification of Allowance mailed Oct. 2, 2012 for Canadian Patent Application No. 2,775,128.
Office Action in U.S. Utility U.S. Appl. No. 12/690,881, mailed on Nov. 2, 2012.
Office Action in Canadian Patent Application No. 2,728,070, mailed on May 12, 2011.
Notification of First Office Action in Chinese Invention Patent Application No. 201110025876.8, issued on May 2, 2012.
Notification of First Office Action in Chinese Utility Model Patent Application No. 201120021903.X, issued on Jun. 17, 2011.
Notification of Second Office Action in Chinese Utility Model Patent Application No. 201120021903.X, issued on Sep. 6, 2011.
Result of Consultation in European Patent Application No. EP11 151 551.6, mailed on May 10, 2012.
Extended European Search Report in European Patent Application No. EP11 150 779.4, mailed on May 3, 2011.
Communication under Rule 71(3) EPC for European Patent Application No. EP11 150 779.4, mailed Jul. 16, 2012.
Office Action in U.S. Utility U.S. Appl. No. 13/004,829, mailed on Sep. 17, 2012.
Notice of Allowance for Canadian Patent Application No. 2728070, mailed on Nov. 3, 2011.
Communication under Rule 71(3) EPC for European Patent Application No. 12001388.3, mailed on Jan. 4, 2013.
Office Action for Korean Patent Application No. 10-2011-0005899, mailed on Apr. 25, 2011.
Notice of Decision for Patent for Korean Patent Application No. 10-2011-0005899, mailed on Aug. 23, 2011.
Notification of First Office Action for Chinese Invention Patent Application No. 201110025891.2, issued on Dec. 13, 2012.
Notification of Grant of Patent Right for Utility Model for Chinese Utility Model Patent Application No. 201120022039.5, issued on May 19, 2011.
Office Action for U.S. Appl. No. 12/831,940, mailed on Jan. 7, 2013.
Notification of Grant of Patent Right for Utility Model for Chinese Utility Model Patent Application No. 201120237927.9, issued on Jan. 20, 2012.
Communication under Rule 71(3) EPC for European Patent Application No. 11172727.7, mailed on Jan. 17, 2013.
Final Office Action for U.S. Appl. No. 13/004,829 mailed Mar. 26, 2013.
Final Office Action for U.S. Appl. No. 12/690,881 mailed Feb. 20, 2013.
Official Letter and Search Report mailed Apr. 19, 2013 for Taiwan Patent Application No. 99145844 and the English translation thereof.
Official Letter and Search Report mailed Apr. 29, 2013 for Taiwan Patent Application No. 100101631 and the English translation thereof.
Response to Non-Final Office Action mailed Jan. 7, 2013 for U.S. Appl. No. 12/831,940, filed Jun. 7, 2013.
Response to Final Office Action mailed Feb. 20, 2013 for U.S. Appl. No. 12/690,881, filed May 20, 2013.
Notice of Allowance mailed May 31, 2013 for U.S. Appl. No. 12/690,881.
Response to Office Action mailed Dec. 13, 2012 for Chinese Invention Patent Application No. 201110025891.2 as filed on Apr. 22, 2013 and the English translation thereof.
Response to Office Action mailed Feb. 19, 2013 for Japanese Patent Application No. 2011-003995 as filed on May 13, 2013 and the English translation thereof.
Initiative Amendment as filed on May 7, 2013 for Chinese Invention Patent Application No. 201210375510.8.
Response to Office Action mailed Feb. 19, 2013 for Japanese Patent Application No. 2011-005928 as filed on May 14, 2013 and the English translation thereof.
Notification of Grant of Patent Right for Invention for Chinese Invention Patent Application No. 201110025891.2 mailed on Jun. 4, 2013.

GOLF BALL WITH COVER HAVING VARYING HARDNESS

BACKGROUND

The present invention relates generally to a golf ball, and a method of manufacturing the golf ball. In particular, a cover layer on the golf ball includes areas having a higher hardness and areas having a lower hardness.

The game of golf is an increasingly popular sport at both the amateur and professional levels. A wide range of technologies related to the manufacture and design of golf balls are known in the art. Such technologies have resulted in golf balls with a variety of play characteristics. For example, different golf balls are manufactured and marketed to players having different golfing abilities, such as different swing speeds.

Similarly, a golfer may use different golf balls having different play characteristics depending on the golfer's preferences. For example, different dimple patterns may affect the aerodynamic properties of the golf ball during flight, or a difference in the hardness of the cover layer may affect the rate of backspin. With regard to hardness in particular, a golfer may choose to use a golf ball having a cover layer and/or a core that is harder or softer. A golf ball with a harder cover layer will generally achieve reduced driver spin, and achieve greater distances. However, a harder cover layer will generally cause a lower rate of spin, such that the golf ball will be better for drives but more difficult to control on shorter shots. On the other hand, a golf ball with a softer cover will generally experience more spin and therefore be easier to control and stop on the green, but will lack distance off the tee.

A wide range of golf balls having a variety of hardness characteristics are known in the art. Generally, the hardness of a golf ball is determined by the chemical composition and physical arrangement of the various layers making up the golf ball. Accordingly, a number of different golf ball materials are mixed and matched in various combinations and arrangements to create golf balls having different hardness values and different hardness profiles.

However, designing golf balls to achieve desired hardness characteristics suffers from at least several difficulties. Generally, the construction of known golf balls requires that a wide range of design variables such as layer arrangement, materials used in each layer, and layer thickness be balanced against each other. Changes to any of these variables may therefore improve a desired hardness only at the expense of other play characteristics. Additionally, materials costs and design costs associated with known golf ball constructions may unduly increase the cost of the golf ball to the end consumer. Perhaps most importantly, known golf balls generally cannot simultaneously achieve the advantageous play characteristics associated with high cover hardness (greater distances) while also achieving the advantageous play characteristics associated with low cover hardness (greater spin).

Therefore, there is a need in the art for a system and method that addresses the shortcomings of the prior art discussed above.

SUMMARY

In one aspect, the invention provides a golf ball comprising a core; and a cover layer, the cover layer substantially surrounding the core and including a plurality of dimples and at least one land area separating the dimples; the cover layer including a first portion, the first portion of the cover layer having a first hardness and at least one dimple thereon, and a second portion, the second portion of the cover layer having a second hardness and at least a part of the at least one land area thereon; wherein the first portion and the second portion are non-overlapping portions of a continuous cover layer material; and the first hardness is higher than the second hardness.

In another aspect, the present disclosure provides the above mentioned golf ball, wherein the first portion of the cover layer has a first degree of crystallinity, the second portion of the cover layer has a second degree of crystallinity, and the first degree of crystallinity is higher than the second degree of crystallinity.

Furthermore, the present disclosure provides a golf ball comprising: a core; and a cover layer substantially surrounding the core, the cover layer being formed of a material having a first hardness, and the cover layer having a plurality of dimples and at least one land area thereon; the plurality of dimples being arranged on the cover layer in a first pattern; the at least one land area being arranged on the cover layer in a second pattern, the first pattern and the second pattern being non-overlapping patterns; wherein the cover layer is coated with a coating material having a second hardness such that the coating material overlaps at least a portion of one of the first pattern and the second pattern but substantially does not overlap the other of the first pattern and the second pattern; and wherein the second hardness is different from the first hardness.

Finally, the present disclosure also provides a method of manufacturing a golf ball, the method comprising the steps of: (1) receiving a golf ball having a core and a cover layer substantially surrounding the core, the cover layer having a plurality of dimples and at least one land area separating adjacent dimples, the plurality of dimples being arranged on the cover layer in a first pattern, the at least one land area being arranged on the cover layer in a second pattern; (2) coating the cover layer with a coating material over at least a portion of at least one of the first pattern and the second pattern; and, if necessary, (3) selectively removing the coating material from the cover layer; whereby the coating material overlaps at least a portion of one of the first pattern and the second pattern but substantially does not overlap the other of the first pattern and the second pattern.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a golf ball having areas on the cover layer that are relatively hard and areas on the cover layer that are relatively soft. The relatively hard areas correspond to at least some of the dimples in the cover layer, and the relatively soft areas correspond to at least part of at least one land area between the dimples. As a result of the arrangement of the hard dimples and the soft land area(s), the golf ball experiences a lower rate of spin when struck with a larger force (such as during a dive) while also experiencing a higher rate of spin and increased control when struck with a smaller force (such as during a chip). The golf ball therefore achieves improved play characteristics associated with harder cover layers (such as longer distance) during drives, while also achieving improved play characteristics associated with softer cover layers (such as higher spin) during short shots.

This disclosure further relates to methods of manufacturing such a golf ball.

Figure 1:
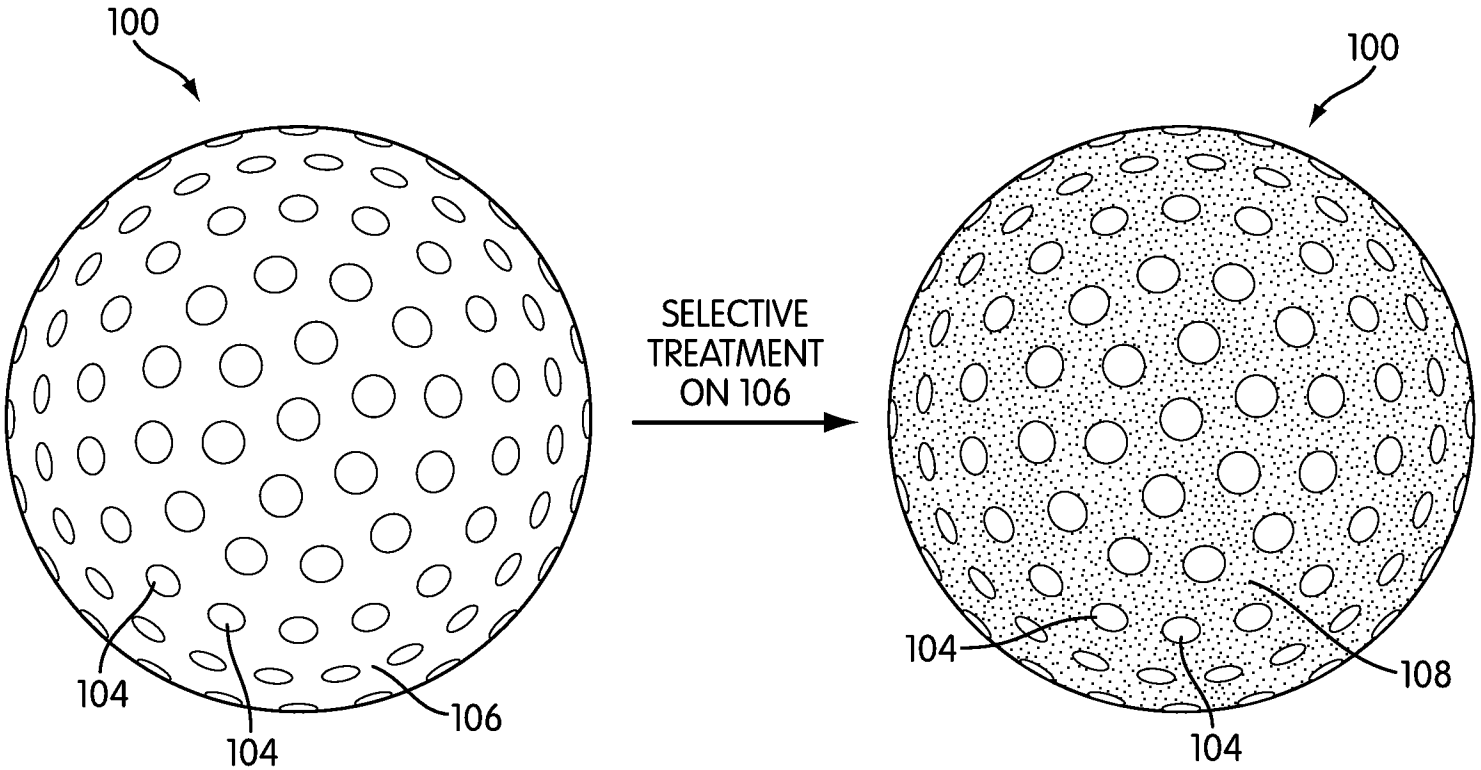
FIG. 1 shows an exemplary golf ball before and after selective treatment.

FIG. 1 shows an exemplary golf ball 100 in accordance with this disclosure. Golf ball 100 is made up of a cover layer having thereon a plurality of dimples 104 and at least one land area 106. Golf ball 100 may generally be any type of golf ball having a core and a cover layer substantially surrounding the core. For example, golf ball 100 may be of a two-piece construction, having only a core and a cover layer, or golf ball 100 may have one or more intermediate layers located between the core and the cover layer. Except as otherwise herein discussed, each layer of golf ball 100 may be formed of any material or construction as is generally known in the art of golf ball manufacturing. For example, various layers of golf ball 100 may be comprised of rubber, rubber composites, thermoplastic polyurethane, highly-neutralized polymers, ionomers, and other polymer materials as are known in the art of golf ball manufacturing.

The plurality of dimples 104 may generally be arranged on the cover layer in any pattern, as may be known in the art of golf balls. Various known dimple packing patterns are known in the art. Dimples 104 may generally be of any shape, such as circular, triangular, or multi-sided. Dimples 104 may be of uniform shape and size, or the dimple pattern may be made up of two or more different types of dimples having (for example) different sizes or different shapes. At least one land area 106 is a part of the cover layer that separates at least two dimples 104 and that is not indented or otherwise part of a dimple. Generally, land area 106 is the "ridge" or "fret" between adjoining dimples 104. Golf ball 100 may include one continuous land area 106 across the entire cover layer, as is shown in FIG. 1, or a plurality of separate land areas between the plurality of dimples 104.

As shown in FIG. 1, golf ball 100 undergoes selective treatment of land area 106. In the embodiment shown in FIG. 1, the selective treatment changes the entirety of land area 106 from a first state into land area 108 in a second state. In other embodiments, the selective treatment may be applied to a portion of land area 106. This selective treatment may comprise a heating step, discussed in further detail below.

Figure 2:
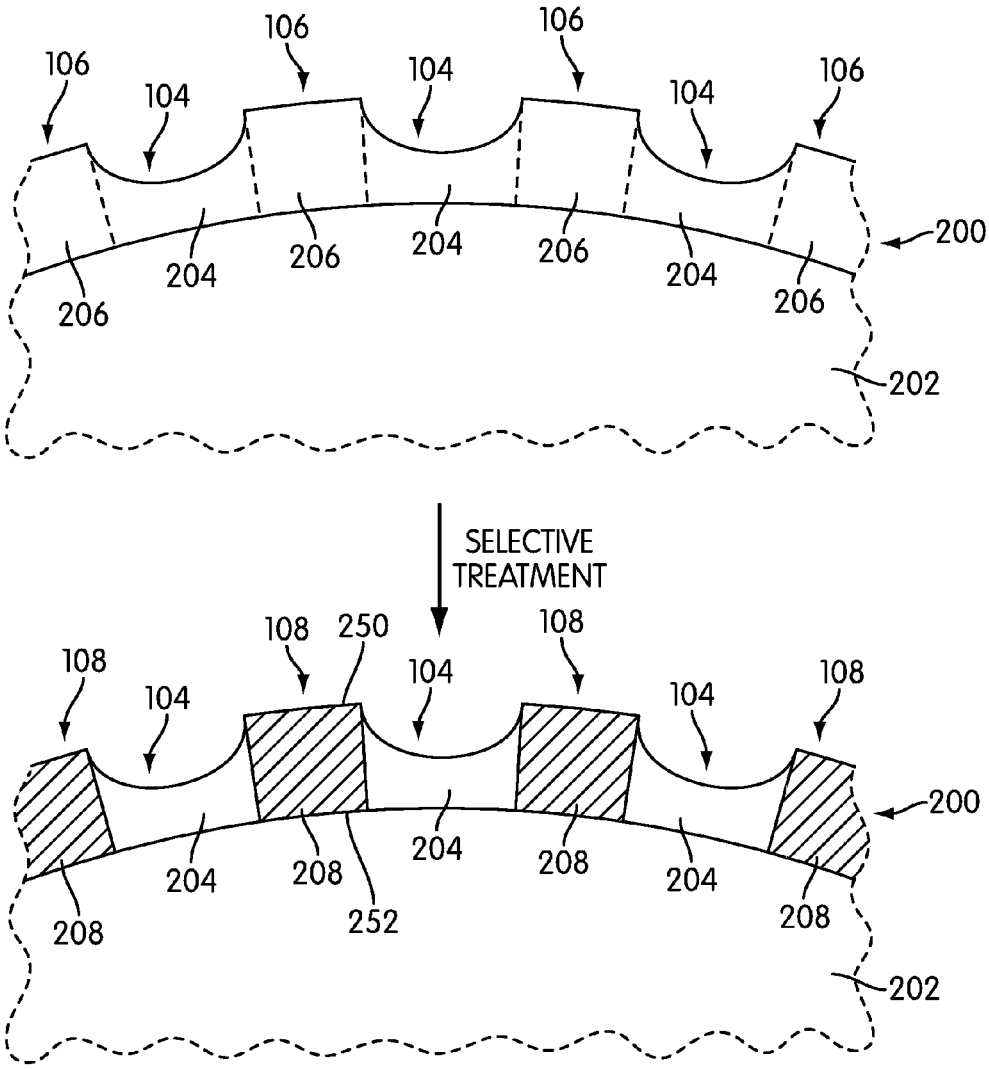
FIG. 2 shows a cross section of the golf ball, before and after the selective treatment.

FIG. 2 shows a cross section of golf ball 100, before and after the selective treatment. In particular, golf ball 100 includes core 202 and cover layer 200. Cover layer 200 includes dimples 104 and land areas 106 thereon. Prior to the selective treatment, cover layer 200 is made up of several sections 204 having at least one dimple 104 thereon, and several sections 206 having at least a part of at least one land area 106 forming the top boundary thereof. After the selective treatment, the sections 206 having a part of at least one land area 106 thereon are changed into a second state 208 as discussed above with respect to land areas in a second state 108.

After the selective treatment, cover layer 200 generally includes a first portion having a first hardness, and a second portion having a second hardness. The first portion generally includes those sections 204 of cover layer 200 having at least one dimple 104 thereon. The first portion may include all sections 204 of cover layer 200 having dimples 104 thereon, or the first portion may include some of the sections 204 but not others. In other words, the first portion as a whole may include all of the dimples 104 thereon, or a subset of fewer than all of the plurality of dimples 104 thereon. Generally, the first portion of cover layer 200 can be made up of any number and arrangement of the sections 204. Similarly, the second portion of cover layer 200 generally includes those sections 208 having at least a part of at least one land area 108 thereon. The second portion may also be made up of all sections 208, or fewer than all of the sections 208. In other words, the second portion as a whole may include the entirety of all of the land area(s) thereon, or may include less than the entirety of all of the land area(s) thereon.

Figure 5:
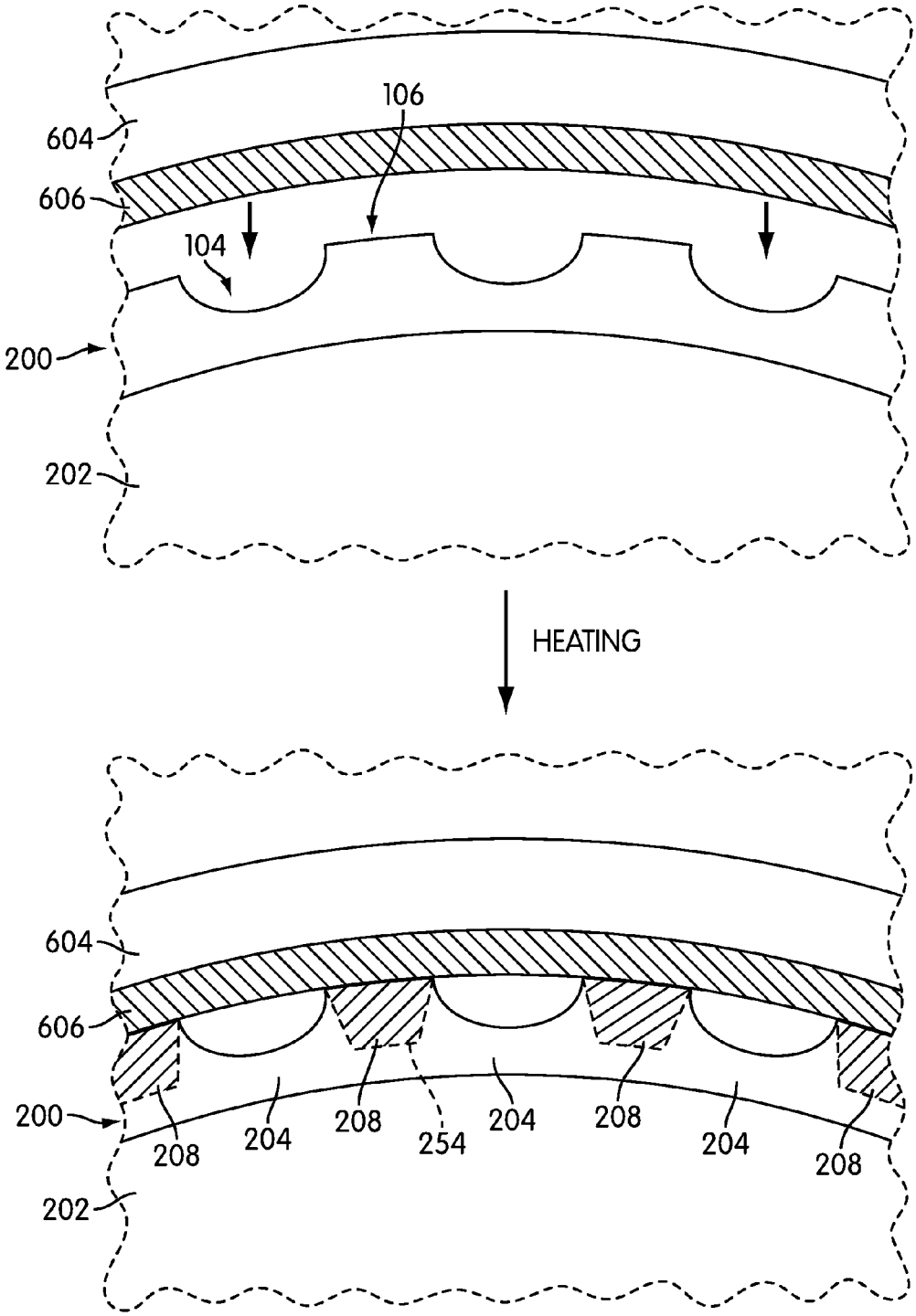
FIG. 5 shows a cross section of the golf ball and heating device, before and after heating.

Either of the first or the second portion may extend through the entire cross-sectional thickness of the cover layer 200, as shown in FIG. 2, or only though a portion of the cross section of cover layer 200, as shown in FIG. 5. Referring again to FIG. 2, specifically, the second portion may extend from an outer surface 250 of cover layer 200 to an inner surface 252 of cover layer 200. Alternatively, as shown in FIG. 5, the second portion may extend from an outer surface 250 of the cover layer 200 to an intermediate point 254 between the outer surface 250 and the inner surface 252 of cover layer 200.

Each of the first portion and the second portions are non-overlapping portions of a continuous cover layer material. Namely, as shown in FIG. 2, the portions 204 and the portions 206 are defined by the dimples 104 and the land 106 but are otherwise parts of the same continuous cover layer 200. In particular embodiments, the first portion and the second portion of cover layer 200 have the same material composition, i.e. there is no difference in the chemical composition of the materials making up the first portion and the second portion.

The first hardness, associated with the first portion of cover layer 200, is higher than the second hardness, associated with the second portion of cover layer 200. Accordingly, the portions of cover layer 200 associated with dimples 104 are generally relatively hard, while the portions of cover layer 200 associated with land areas 108 are generally relatively soft. The degree of difference in hardness between the first portion and the second portion may be any non-trivial difference in hardness. In certain embodiments, the hardness of the first portion may be at least about 3 units on the Shore D scale harder than the hardness of the second portion. In other embodiments, the first potion may be at least about 5 units on the Shore D scale harder than the second portion.

Cover layer 200 is generally made of any material that can change in hardness in response to a selective treatment. In particular embodiments where the selective treatment comprises heating, cover layer 200 may comprise a phase transition material as described in U.S. Patent Application Publication No. 2008/0081710 (hereinafter referred to as "the '710 Publication"), the disclosure of which is hereby incorporated in its entirety. Specifically, the phase transition material described in the '710 Publication is an acid copolymer that comprises copolymerized residues of at least one alpha olefin having from two to six carbon atoms and copolymerized residues of at least one α,β-ethylenically unsaturated carboxylic acid having from 3 to 8 carbon atoms.

As described in the '710 Publication, this phase transition material changes hardness in response to heating. Specifically, heat energy decreases the hardness by disrupting the material's secondary crystal structure. As is generally known in the arts of polymer science, the hardness of a semi-crystalline polymer material can be proportional to the degree of crystallinity of the polymer material. The degree of crystallinity is the amount of the material that is in a crystalline phase, as compared to the amount of the material that is in an amorphous phase. The crystalline phase is generally harder than the amorphous phase, due to the close-packing crystal structure of the polymer molecules therein.

Figure 3:
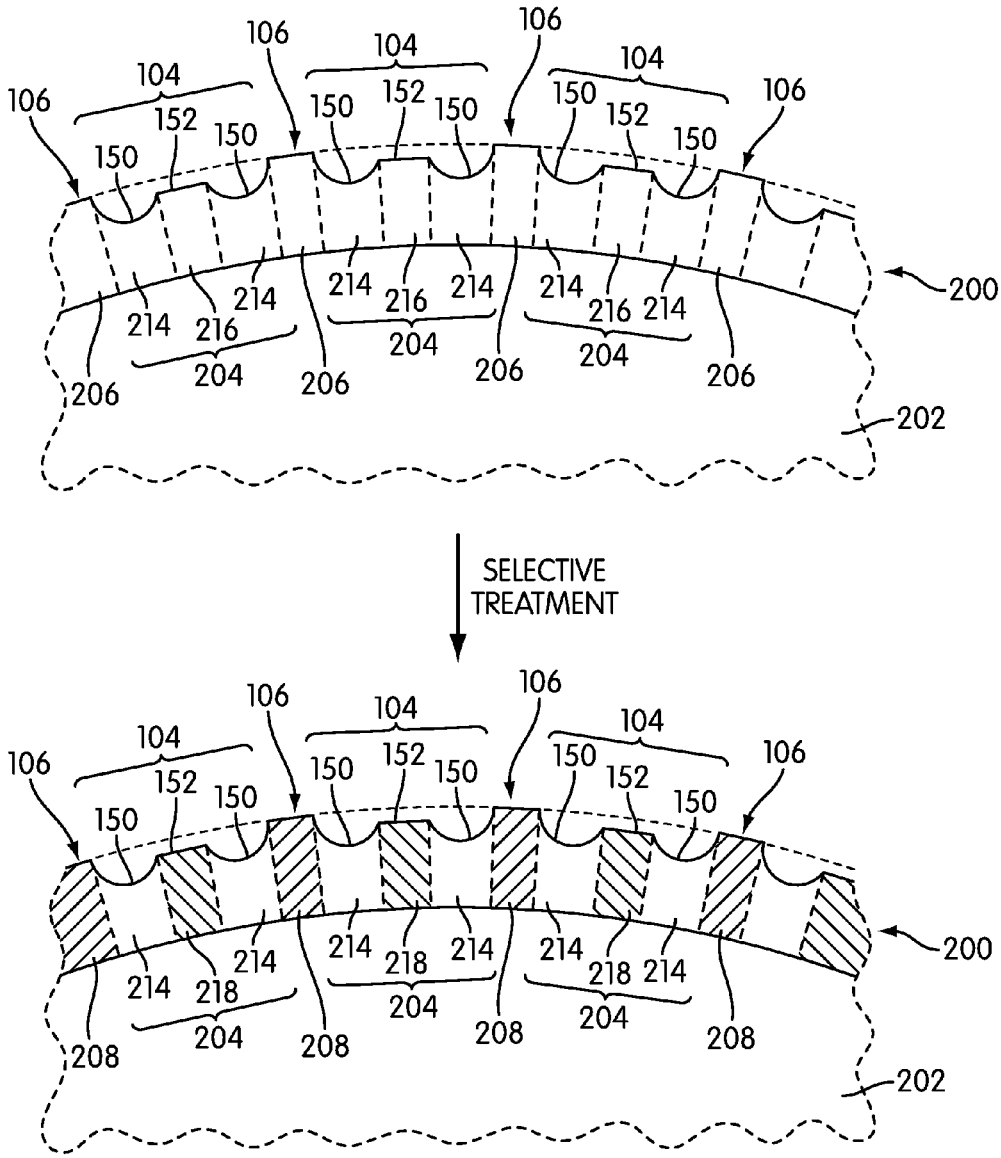
FIG. 3 shows a cross section of a golf ball having an alternative dimple pattern.

Therefore, golf ball 100 may be heated in a heating device 600 as shown in FIG. 3 in order to achieve the desired difference in hardness. The heating device 600 is fully described in U.S. Pat. No. 8,283,603, entitled Device for Heating a Golf Ball, and filed on Oct. 23, 2009, the disclosure of which is hereby incorporated in its entirety. Heating device 600 is held by a user's hand 602 and moved, as shown, such that heating surface 106 is brought into contact with the golf ball 100.

Specifically, as shown in FIG. 5, cover layer 200 may be selectively heated by a heating element 606 in order to achieve the desired difference in hardness. Specifically, heating element 606 may be brought into contact with the land areas 106 of cover layer 200. The sections of cover layer 200 closest to the surface of land areas 106 touching heating element 606 are therefore heated. These sections form the second portion of the cover layer, as described above. In the embodiment described here, and as shown in FIG. 5, the second portion extends from the outer surface 250 of the cover layer 200 to an intermediate point 254 between the outer surface 250 and the inner surface 252, depending on the nature and extent of the heat applied by the heating element 606. As a result of the selective heating applied to the land areas 106, the first portion of cover layer 200 (encompassing untreated sections 204) has a first hardness that is higher than the second hardness of the second portion (encompassing treated sections 208). Specifically, the secondary crystal structure of the second portion has been disrupted, and so the degree of crystallinity of the first portion is higher than the degree of crystallinity of the second portion.

Although FIG. 5 only shows this selective heating process being applied to a particular cross section of the cover layer 200, this selective heating process may be applied to the entire surface of golf ball 100, such that all land areas 106 are heated. Alternatively, the selective heating process may be applied to certain land areas 106 on different locations on golf ball 100, but not others, as may be desired. In either case, the second portion of cover layer 200 will encompass only those portions of cover layer 200 that are heated, and therefore have a difference in hardness from the first portion of cover layer 200.

In another embodiment, the cover layer 220 may comprise a semi-crystalline thermoplastic material. Methods for changing the hardness of semi-crystalline thermoplastic materials are fully described in U.S. Patent Application Publication No. 2011/0177890, entitled Methods and Systems for Customizing a Golf Ball, and filed on Jan. 20, 2010, the disclosure of which is hereby incorporated in its entirety.

Figure 6:
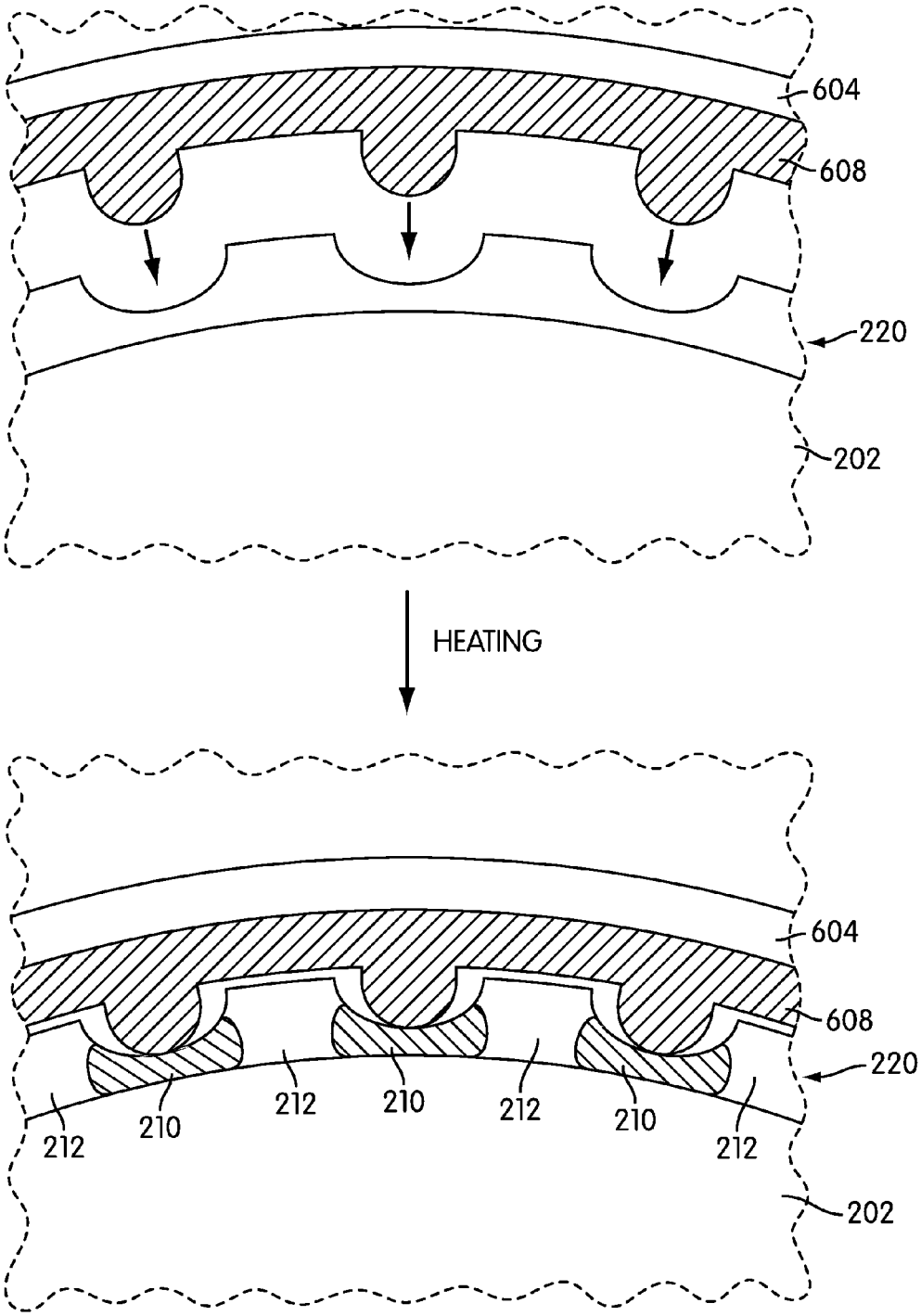
FIG. 6 shows a cross section of a portion of the golf ball and a second heating device, before and after heating.

Specifically, as is shown in FIG. 6, heating element 608 may be used to heat sections 210 of the cover layer 220 associated with the dimples 104. In accordance with the methods described in the '493 Application, these sections 210 may be heated to increase the movement of the polymer molecules in the semi-crystalline thermoplastic material, and subsequently slowly cooled such that the degree of crystallinity in these sections 210 increases. Sections 210 therefore collectively make up the first portion of cover layer 200, as described above, and have a hardness that is higher than the un-heated sections 212 collectively making up the section portion. In such embodiments, again, the degree of crystallinity of the first portion of cover layer 200 is higher than the degree of crystallinity of the second portion. In other words, the first portion has a first degree of crystallinity, and the second portion has a second degree of crystallinity, where the first degree of crystallinity is higher than the second degree of crystallinity.

Figure 4:
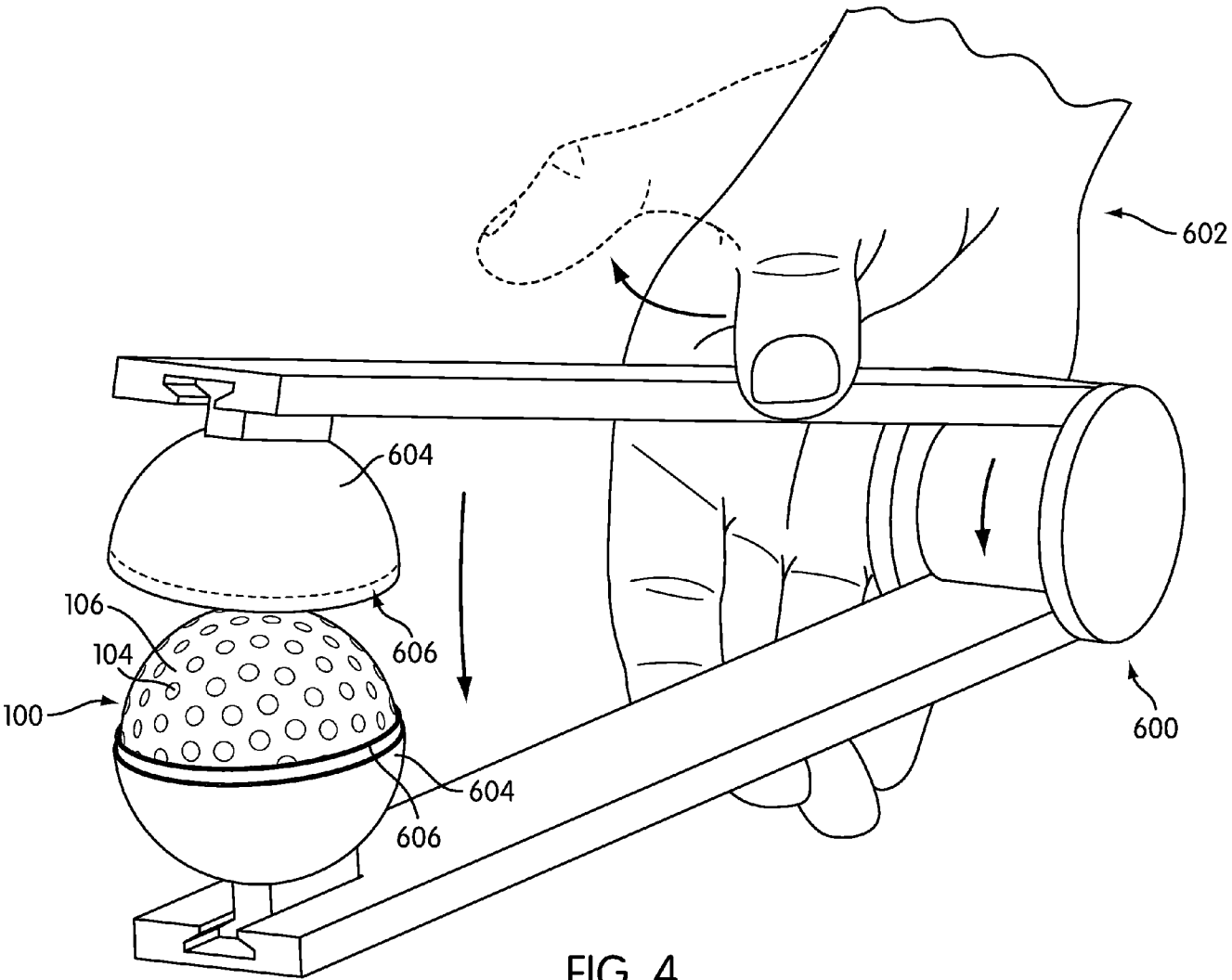
FIG. 4 shows a heating device that can be used to achieve selective heating.

The heating element 606, or heating element 608, used in the methods described above may generally be any heating mechanism that is capable of selectively heating the desired portions of the cover layer. In a particular embodiment, as mentioned above and shown in FIG. 4, the heating element may be a component of the heating apparatus described fully in U.S. patent application Ser. No. 12/604,830 (hereinafter referred to as "the '830 Application"). In such embodiments, the heating element 606 or the heating element 608 may be the internal heating surface as described in the '830 Application. Similarly, the heating element backing 604, shown in FIGS. 5 and 6, may be the external housing described in the '830 Application. The device described in the '830 Application allows a consumer to create a desired difference in hardness in accordance with the present disclosure through the use of a particular pattern on the internal heating surface.

Figure 7:
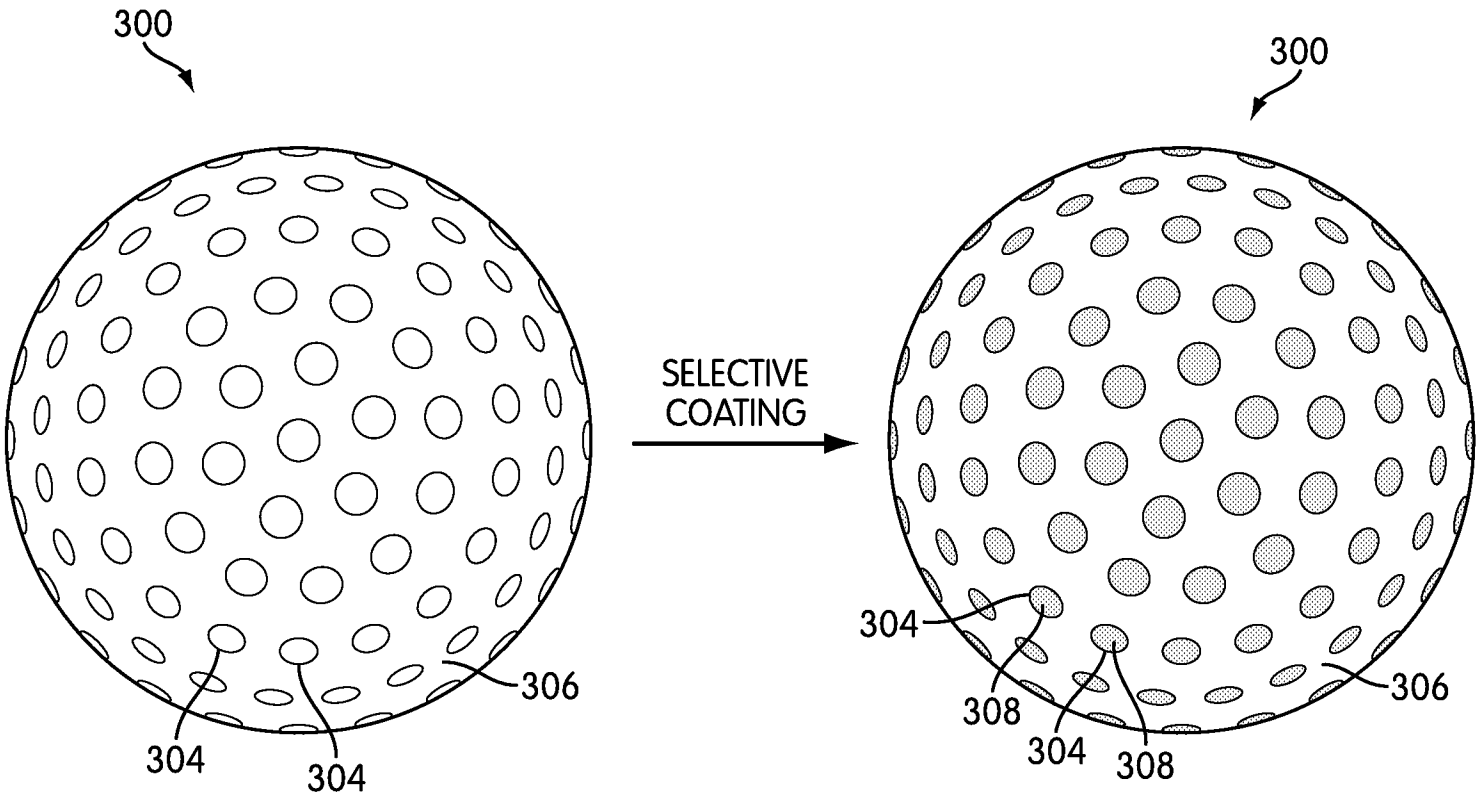
FIG. 7 shows an exemplary golf ball before and after selective coating.

In different embodiments than those discussed variously above, the difference in hardness between the dimples and the land areas can be achieved through the use of a coating material. FIG. 7 shows a golf ball 300 in accordance with these embodiments, and a general process for making such a golf ball. Generally, a golf ball 300 may comprise a core and a cover layer substantially surrounding the core, where the cover layer is formed of a material having a first hardness and has a plurality of dimples 304 and at least one land area 306 thereon. The plurality of dimples 304 may be arranged on the cover layer in a first pattern, and the at least one land 306 area may be arranged on the cover layer in a second pattern, where the first pattern and the second pattern are non-overlapping patterns. Then, the cover layer may be coated with a coating material 308 having a second hardness, such that coating material 308 overlaps at least a portion of one of the first pattern and the second pattern, but substantially does not overlap the other of the first pattern and the second pattern. The second hardness is different from the first hardness.

In the embodiment shown in FIG. 7, the coating material 308 is selectively applied on the first pattern corresponding to the dimples 304. In such an embodiment, the second hardness (i.e., the hardness of the coating material) is higher than the first hardness (i.e., the hardness of the cover material). Therefore, coating material 308 makes the dimples 304 hard while the cover layer, exposed on the land areas 306, is soft. Although FIG. 7 shows all of the dimples 304 being coated with the coating material 308, coating material 308 may alternatively coat only a portion of the first pattern.

Figure 8:
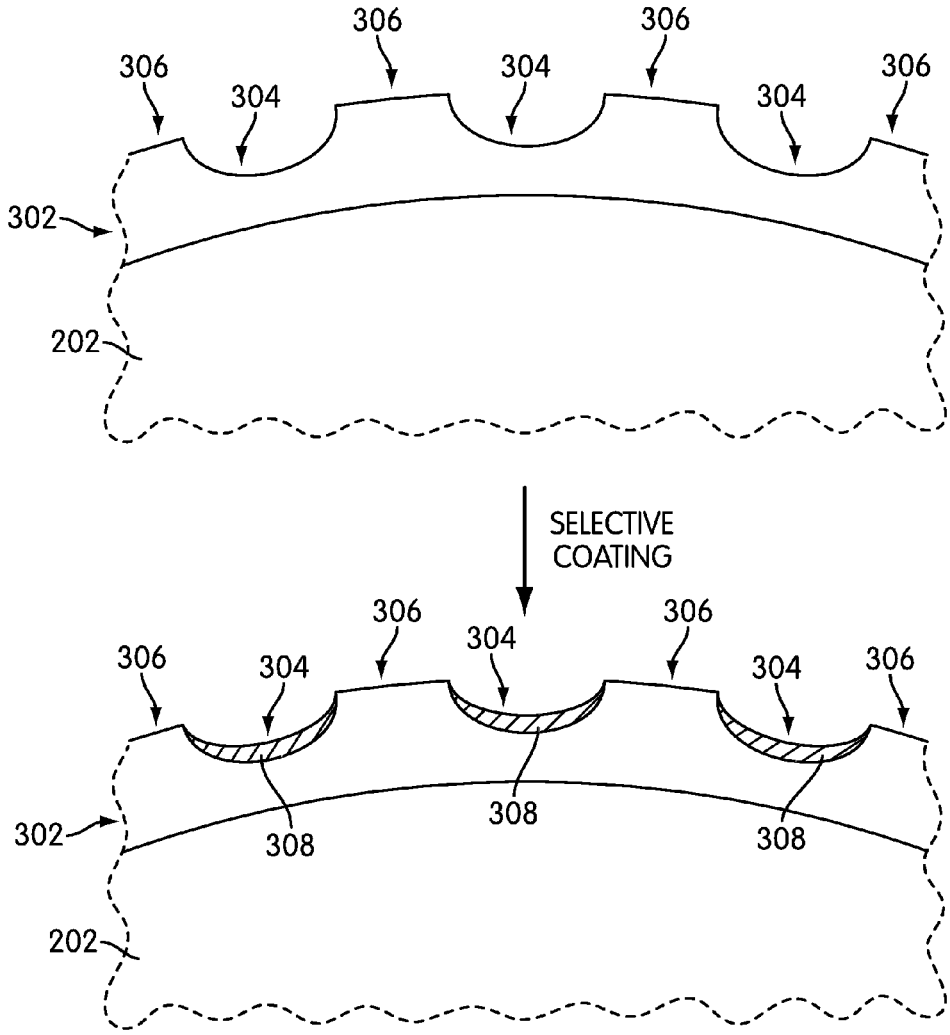
FIG. 8 shows a cross section of a portion of a golf ball cover layer, before and after the selective coating.

FIG. 8 shows a cross-sectional view of the dimples 304 and land areas 306 shown in FIG. 6. In FIG. 8, coating material 308 is coated on top of each of the dimples 304, forming a thin layer of coating material 308 on a cover layer 302. The thickness of the coating material 308 may generally be any thickness that fits within a dimple. Coating material 308 should generally not be so thick as to significantly affect the aerodynamics of the golf ball, however coating material 308 may be applied in such a way as to achieve a desired dimple depth configuration. In certain embodiments, cover layer 302 may have a thickness of about 2 mm or less. Accordingly, in these embodiments coating material 308 may have a thickness that is, for example, on the order of 0.5 mm or less, or 0.3 mm or less, or 0.1 mm or less.

Figure 9:
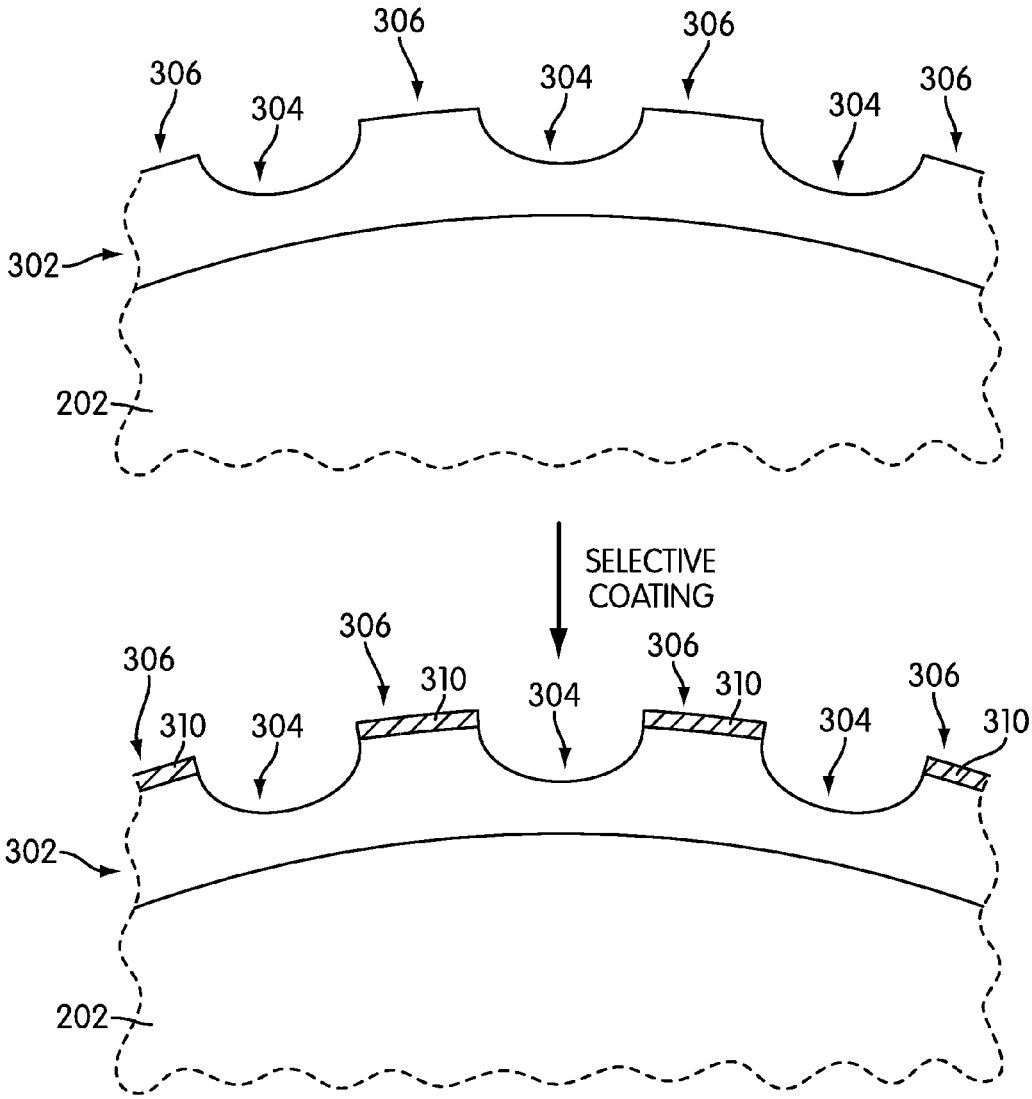
FIG. 9 shows a cross section of a portion of a golf ball cover layer, before and after a different selective coating.

FIG. 9 shows another embodiment, wherein land areas 306 are coated with a coating material 310. In this embodiment, coating material 310 covers at least a part of the second pattern, the second pattern corresponding to the land areas 306. As mentioned above with respect to the embodiment in FIG. 8, in the embodiment of FIG. 9 coating material 310 may generally cover all of the second pattern or less than all of the second pattern in any arrangement as may be desired. In embodiments where coating material 310 covers at least a part of the second pattern, the second hardness (i.e., the hardness of coating material 310) is less than the hardness of the cover layer material. Accordingly, land areas 306 coated with coating material 310 are relatively soft, while dimples 104 are relatively hard.

Figure 10:
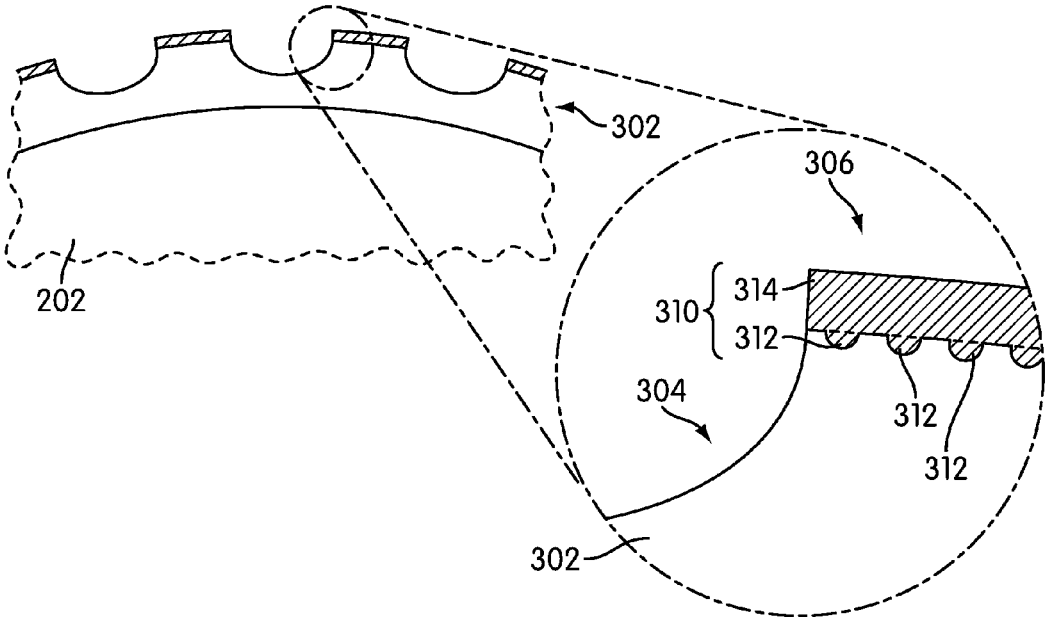
FIG. 10 shows a cross section of a portion of a golf ball cover layer, in further detail.
Figure 11:
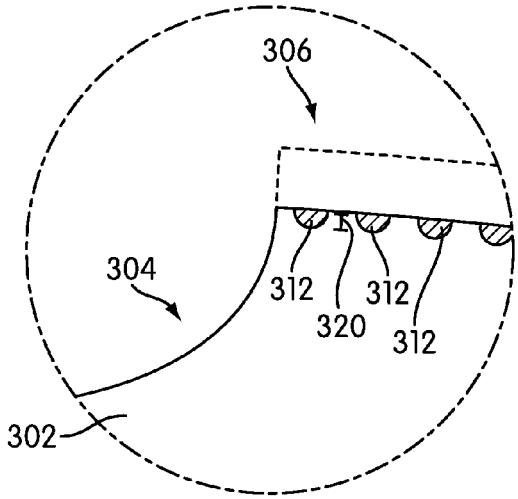
FIG. 11 shows a close-up cross section of a portion of a golf ball cover layer, after a part of a selective coating has been removed.
Figure 12:
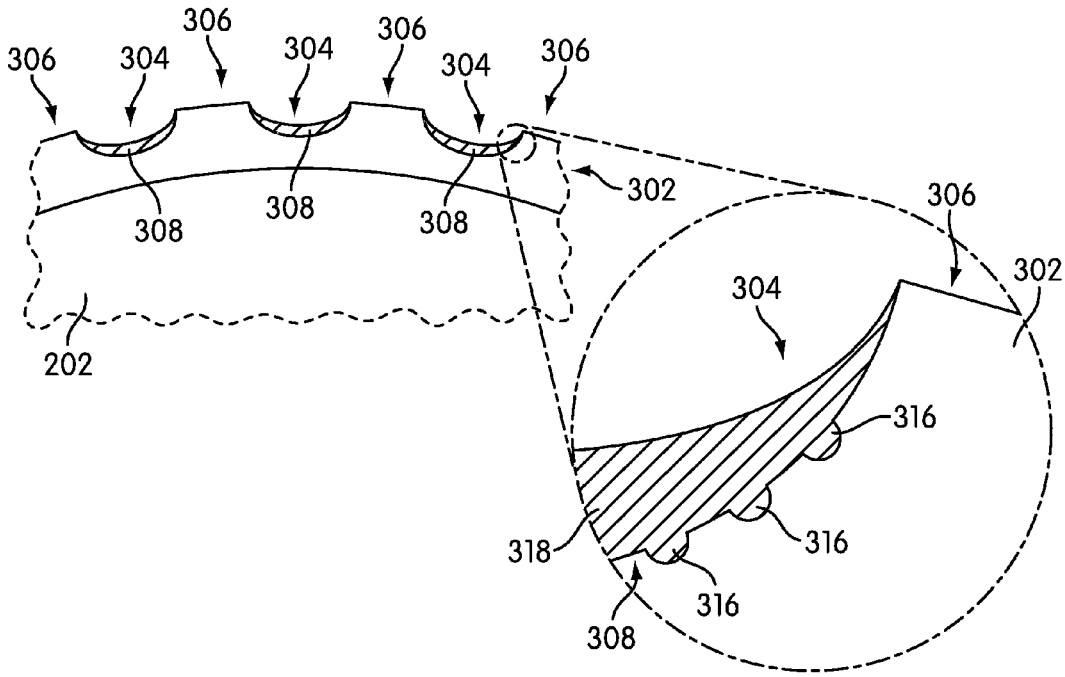
FIG. 12 shows a second embodiment of a cross section of a portion of a golf ball cover layer, in further detail.
Figure 13:
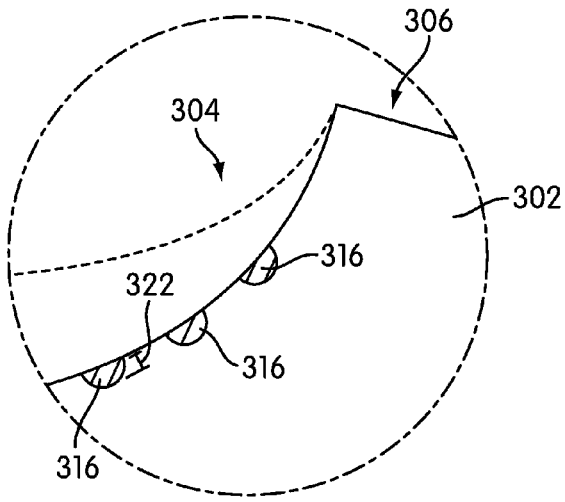
FIG. 13 shows a second embodiment of a close-up cross section of a portion of a golf ball cover layer, after a part of a selective coating has been removed.

FIGS. 10 and 11 show a further feature of the coating that may be used in conjunction with any of the above discussed embodiments. Specifically, FIG. 10 shows several pockets 312 in the surface of the cover layer 302. Although FIG. 10 shows pockets 312 as being located on cover layer 302 corresponding to land area 306, pockets 312 may equally be located on cover layer 302 corresponding to dimples 304, as shown in FIGS. 12 and 13. Generally, pockets 312 are small indentations or abrasions intentionally formed in the surface of cover layer 302. Pockets 312 generally have a depth 320 that is at least less than the depth of dimple 304, and, in some embodiments, significantly less than the depth of dimples 304. In embodiments where cover layer 302 has a thickness of about 2.0 mm, the pockets 312 may have a depth 320 of less than about 0.5 mm, less than about 0.3 mm, or less than about 0.1 mm. Pockets 312 may enable coating material 308, 310 to better adhere to cover layer 302. Pockets 312 may also allow more flexibility in the design of the golf ball, such as by achieving a desired difference in hardness without, for example, changing the dimple depth or total diameter of the golf ball.

When coating material 310 is coated on cover layer 302 having pockets 312 therein, coating material 310 fills the pockets 312 as well as coats the surface of cover layer 302 with a top section 314 of coating material 310. The top section 314 of coating material 310 may be left in place on the second pattern on top of land areas 306, if desired, or may be removed to leave coating material 310 only in the pockets 312. FIG. 11 show coating material present only the pockets 312. As shown in FIG. 11, the coating material is located in the pockets, but does not otherwise substantially overlap the surface of cover layer 302.

FIGS. 12 and 13 show an embodiment wherein pockets 316 are made in the surface of cover layer 302 located on dimple 304. Similar to as discussed above, coating material 308 may include a top section 318 as well as fill the pockets 316. The top section 318 of coating material 308 may then be removed, if so desired, leaving coating material 308 only in pockets 316. Pockets 316 in dimple 304 have a depth 322 that may be the same as or different from depth 320 of pockets 312 associated with land area 306.

In these embodiments including pockets 312 and/or pockets 316, generally, the coating material may be used to change the hardness of the second pattern in accordance with this disclosure, without changing the diameter or aerodynamic performance of the golf ball. Therefore a wider range of golf ball designs may be used in accordance with the present disclosure, without the need to redesign the physical structure of the golf ball or sacrifice advantageous aerodynamic properties.

The coating material may generally be selected in accordance with the desired hardness. In embodiments, such as are shown in FIGS. 7 and 8, wherein the coating material has a hardness higher than the hardness of the cover layer material, the coating material may be a hard polymer or a metal plating. A wide range of polymers are known in the art that have high hardness values. The hardness of a polymer material may generally be controlled by, for example, the degree of cross-linking, the degree of crystallinity, and the chain length. In a specific embodiment, for example, the cover layer material may be a thermoplastic polyurethane (TPU) having a hardness of about 45 to 60 on the Shore D scale, and the coating material may be a thermoplastic polyurethane having a hardness of about 65 on the Shore D scale. Generally, the polymer coating material may be any thermoplastic, thermoset, ionomer, copolymer, or other polymer material known and used in the art of golf balls.

Additionally, the coating material may be a metal plating. Nearly any typical metal may be used, as most metals have a hardness at conventional temperatures that is higher than polymer materials conventionally used to form golf ball cover layers. Exemplary metals that may be used as the coating material include aluminum, steel, tungsten, titanium, magnesium, and iron alloys, among a variety of others. The metal coating material may be selected based on hardness, workability, and cost effectiveness.

Figure 14:
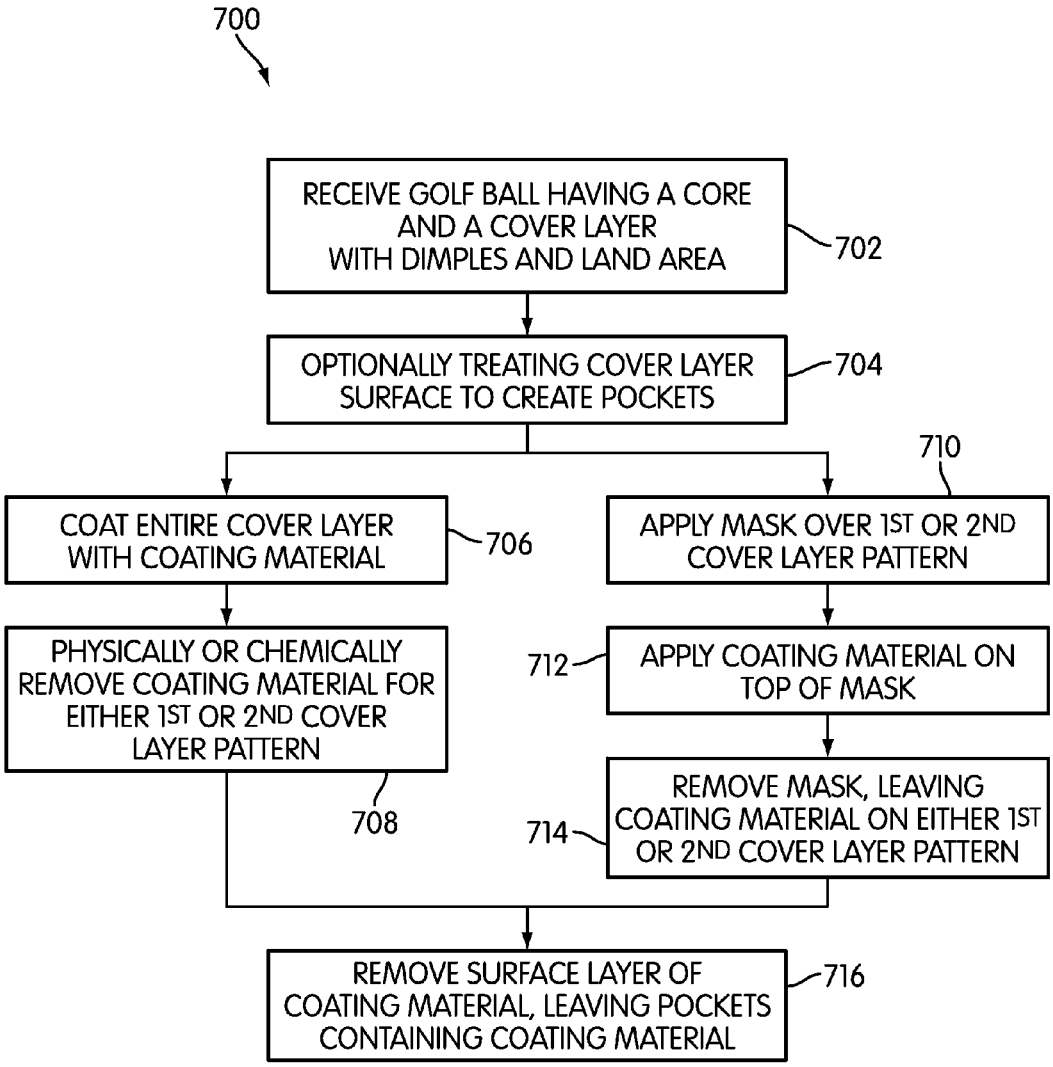
FIG. 14 is a flowchart detailing a method of manufacturing a golf ball, including optional steps.

FIG. 14 is a flowchart detailing a method of manufacturing the golf ball discussed above, including optional steps. Generally, a method 700 of manufacturing a golf ball includes first step 702 of receiving a golf ball having a core and a cover layer with a plurality of dimples and at least one land area thereon. The golf ball may then undergo an optional preliminary step of treating the cover layer so as to create pockets 312 in the cover layer. This preliminary treatment step may be, for example, a physical surface roughening, or a chemical etching that etches only a small portion of the cover layer such as an unmasked portion of the surface of the golf ball.

Next, method 700 of manufacturing the golf ball may take either of two general routes. In a first step 706 of a first route, the entire cover layer is coated with the coating mater. The coating may be a physical coating step, such as by brushing, dipping, spraying or other physical application means. Alternatively, the coating may be a chemical coating step, such as chemical vapor deposition (CVD), plasma spray coating, or other chemical application means. The coating material is then selectively removed in step 708, such that the coating layer remains only on either of the first or second pattern, as desired. The removal of the coating material may be a physical grinding away of the coating, or may be a chemical removal such as by chemical etching using a mask to protect selected coated areas to prevent the removal of selected coated areas.

Alternatively, in step 710 a mask may be applied over the golf ball. The mask may be a physical mask having a pattern of holes corresponding to either of the first pattern or the second pattern. The coating material is then 712 applied on top of the mask, after which 714 the mask is removed, leaving the coating material on only the pattern corresponding to the holes in the mask.

Finally, if the golf ball underwent step 704 to create pockets, the surface portion of the coating material 314 may be removed in step 716. This step leaves the coating material in only the pockets, and not otherwise substantially overlapping the surface of the cover layer.

Figure 15:
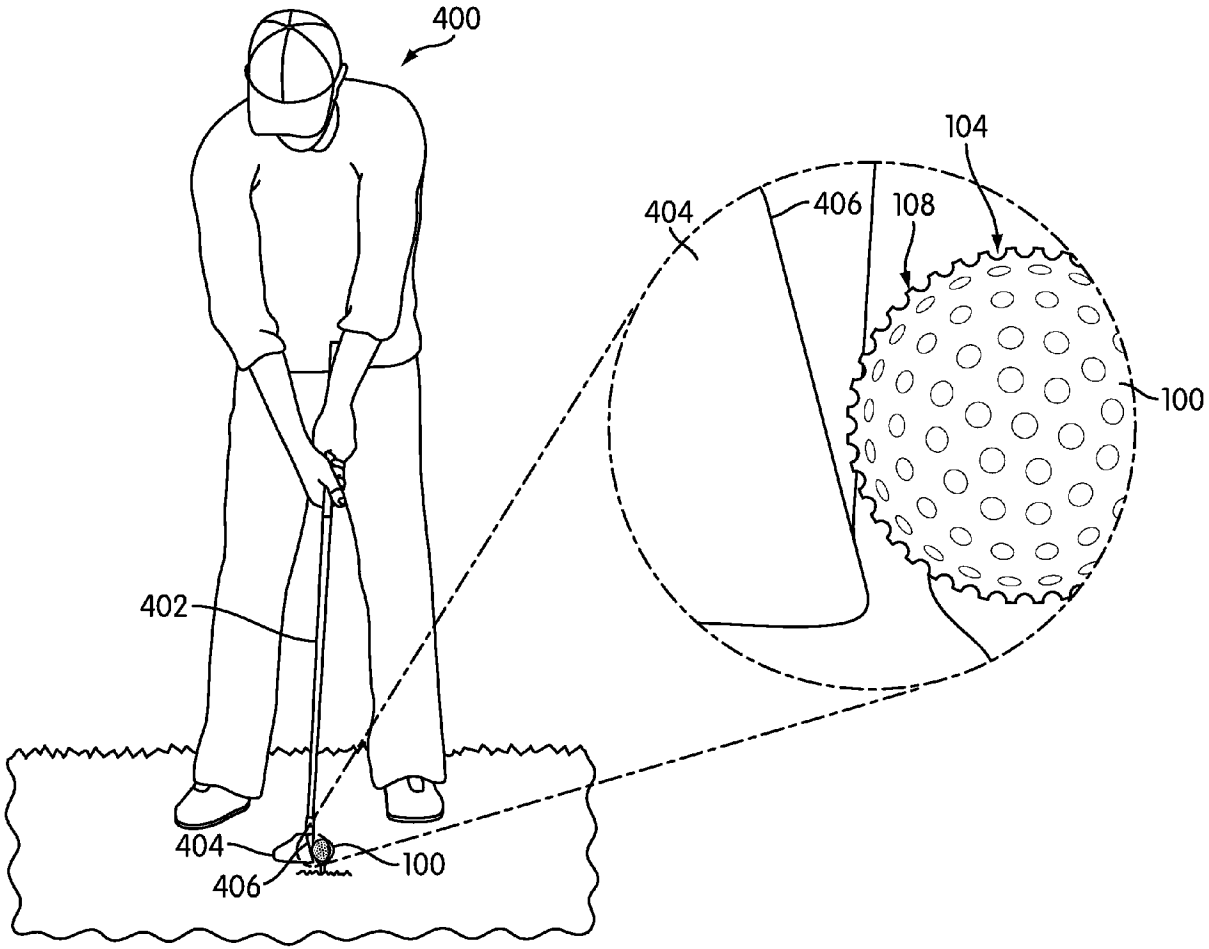
FIG. 15 shows a golfer about to hit a golf ball with a driver, and a detailed view of the golf ball prior to being hit by the driver.
Figure 16:
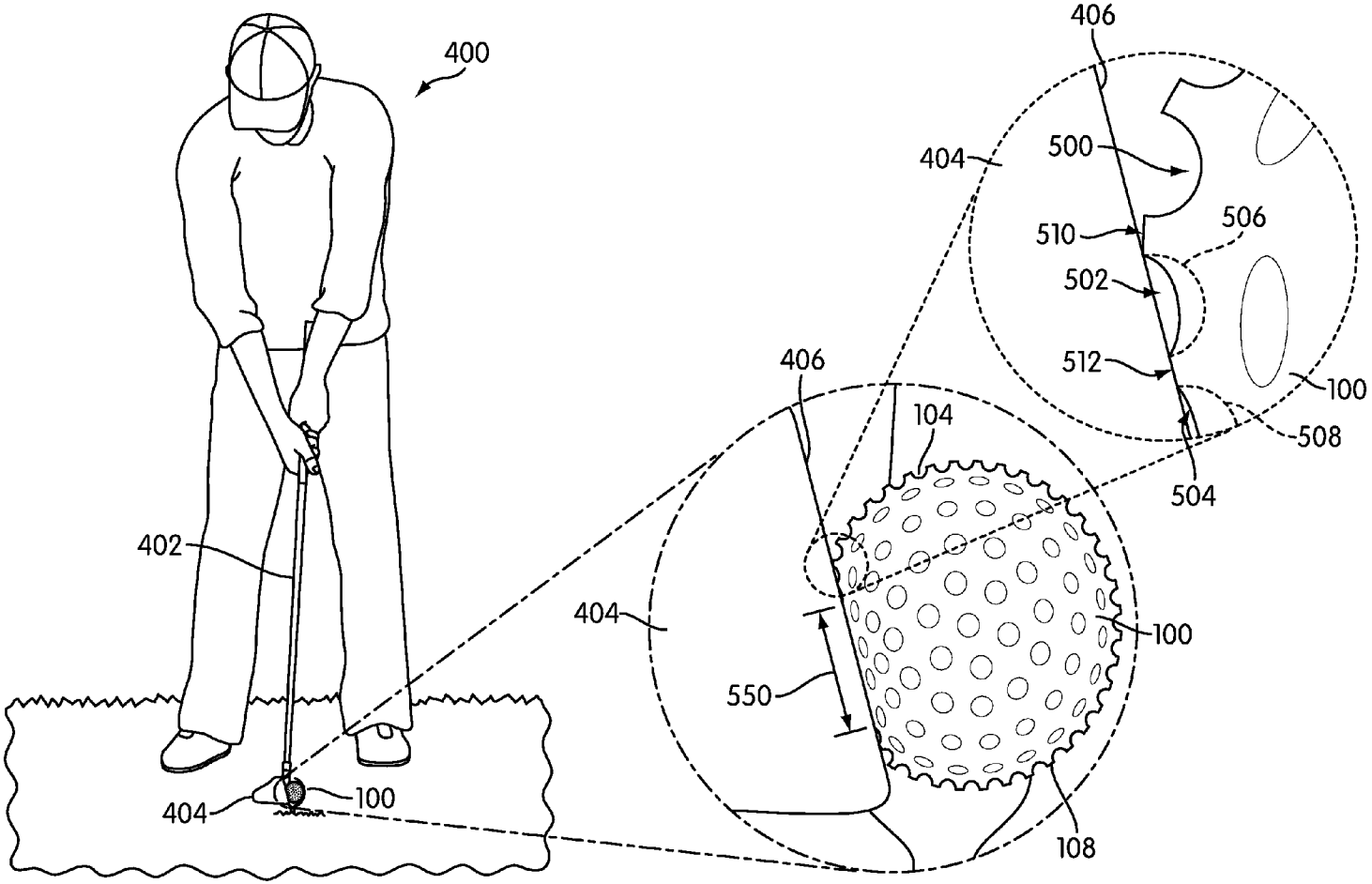
FIG. 16 shows the golfer hitting a golf ball with a driver, and two detailed views of the golf ball as it is being hit by the driver.

Although not wishing to be bound by any particular theory of action, it is believed that the golf ball of the present disclosure achieves superior play characteristics due to the interaction between a golf club face and the golf ball as is shown in FIGS. 14-16.

In FIG. 15, a golfer 400 swings a golf club 402 toward golf ball 100. It is noted that golf ball 100 is referenced here, however the same results are achieved by golf ball 300. The golf club 402 is a driver, having a large club head 404, and a club face 406 that is wide and has a low loft angle. As seen in the zoomed-in section of FIG. 12, the golf ball 100 includes dimples 104 and land area 108 (as in FIG. 1).

In FIG. 16, the club face 406 strikes the golf ball 100 with a large amount of force, in accordance with a drive. The golf ball 100 therefore deforms, as is shown in the first zoom-in section. Specifically, the golf ball 100 deforms such that a first area 550 of the golf ball cover layer is flat against the club face 406. In first area 550, the club face 406 impacts both the land areas and the dimples, compressing them against core 202 (and any inner layers). In this first area 550 where both the hard dimples 104 and the soft land 108 are flat against the club face, the cover layer "appears" to have a hardness that is between the hardness of the dimples and the hardness of the land (depending on the ratio of each). By "appears" is meant: how the club face 406 interfaces with the cover layer in this area.

In particular, as seen in the second zoomed-in section of FIG. 16, at the periphery of first area 550, the club face impacts the land while impacting the dimples to varying degrees. Specifically, first dimple 500 is not impacted at all, while first land area 510 is impacted to a slight degree. Second dimple 502 is impacted only slightly, as shown by the difference between the present shape of dimple 502 and the original shape denoted by outline 506, because the first land 510 and second land 512 are partially but not entirely compressed. Similarly, third dimple 504 is also impacted somewhat but not entirely, as shown by outline 508. Therefore, during a golf shot involving a high degree of force (such as a drive), the golf ball 100 undergoes compression such that the club face touches at least some of the relatively hard surfaces of the dimples.

Figure 17:
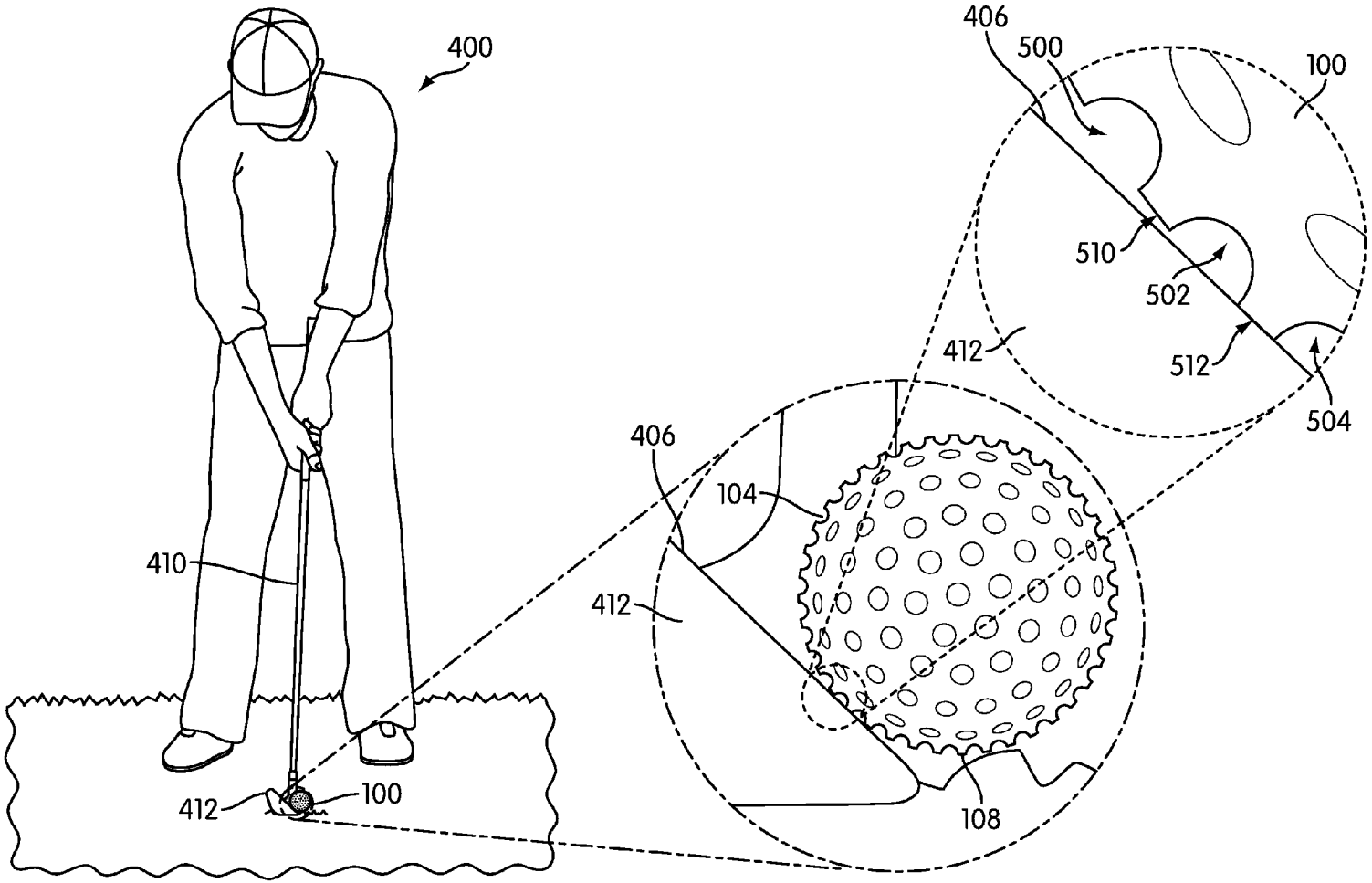
FIG. 17 shows the golfer hitting a golf ball with a iron, and two detailed views of the golf ball as it is being hit by the iron.

FIG. 17 shows a different type of golf shot in action. In FIG. 17 the golf club 410 is, for example, an iron. Club head 412 on iron 410 has a higher loft angle, as seen by the angle of the club face 406 in the first zoomed-in section of FIG. 17. In this scenario, the golf ball is hit with less force than in FIG. 16. Therefore, golf ball 100 does not compress against club face 406 so as to deform the dimples, as shown in the first zoomed-in section of FIG. 17. FIG. 17 shows a periphery of the deformed second area 560, where club face 406 again impacts first land 510 and second land 512, but in this case does not deform first dimple 500, second dimple 502, or third dimple 504. Therefore, the apparent hardness of the cover layer is lower, as compared to the apparent hardness of the cover layer under compression shown in FIG. 16, because the club face 406 only touches relatively soft land areas 108 without also touching the relatively hard surfaces of dimples 104.

Thus, the present golf ball appears to be softer when hit with less force, but harder when hit with more force. Thereby, the present golf ball achieves improved play characteristics associated with harder cover layers (such as longer distance) during drives, while also achieving improved play characteristics associated with softer cover layers (such as higher spin) during short shots. Furthermore, golf balls made in accordance with this disclosure may also simultaneously achieve improved play characteristics that are unrelated to the hardness.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core; and a cover layer substantially surrounding the core, the cover layer being formed of a material having a first hardness, and the cover layer having a plurality of dimples and at least one land area thereon;

the plurality of dimples being arranged on the cover layer in a first pattern;

the at least one land area being arranged on the cover layer in a second pattern, wherein the cover layer is coated with a coating material having a second hardness such that the coating material overlaps at least a portion of one of the dimples and the at least one land area, but substantially does not overlap the other of the dimples and the at least one land area; and wherein the second hardness is different from the first hardness.

2. The golf ball of claim 1, wherein the coating material overlaps at least a portion of the dimples but does not substantially overlap the at least one land area, and the second hardness value is higher than the first hardness value.

3. The golf ball of claim 2, wherein the coating material overlaps substantially all of the dimples.

4. The golf ball of claim 1, wherein the coating material overlaps at least a portion of the at least one land area but does not substantially overlap the dimples, and the second hardness value is lower than the first hardness value.

5. The golf ball of claim 4, wherein the coating material overlaps substantially all of the at least one land area.

6. The golf ball of claim 1, wherein at least one of the dimples or the at least one land area includes pockets therein, and the coating material is coated on one of the dimples or the land areas such that the coating material fills the pockets and coats the one of the dimples or the land areas.

7. The golf ball of claim 1, wherein the coating material is selected from the group consisting of a metal plating and a polymer.

* * * * *